US007965245B2

(12) United States Patent
Keski-Opas

(10) Patent No.: US 7,965,245 B2
(45) Date of Patent: Jun. 21, 2011

(54) ANTENNA

(75) Inventor: Petri Keski-Opas, Tampere (FI)

(73) Assignee: Nokia Corporation, Espoo (FI)

( * ) Notice: Subject to any disclaimer, the term of this patent is extended or adjusted under 35 U.S.C. 154(b) by 66 days.

(21) Appl. No.: 12/386,309

(22) Filed: Apr. 15, 2009

(65) Prior Publication Data

US 2009/0239104 A1 Sep. 24, 2009

Related U.S. Application Data

(62) Division of application No. 11/412,623, filed on Apr. 26, 2006, now Pat. No. 7,538,730.

(51) Int. Cl.
*H01Q 1/24* (2006.01)

(52) U.S. Cl. ..... 343/702; 429/163; 429/8

(58) Field of Classification Search ..... 34/702; 429/8, 163; 343/702
See application file for complete search history.

(56) References Cited

U.S. PATENT DOCUMENTS

| | | | | |
|---|---|---|---|---|
| 3,930,889 | A | 1/1976 | Ruggiero et al. | 136/173 |
| 4,876,552 | A | 10/1989 | Zakman | 343/702 |
| 5,528,222 | A | 6/1996 | Moskowitz et al. | 340/572 |
| 5,809,433 | A * | 9/1998 | Thompson et al. | 455/575.7 |
| 5,818,198 | A * | 10/1998 | Mito et al. | 320/112 |
| 6,028,555 | A | 2/2000 | Harano | 343/702 |
| 6,104,920 | A | 8/2000 | Llewellyn et al. | 455/269 |
| 6,828,940 | B2 | 12/2004 | Mueller | 343/702 |
| 2002/0041175 | A1 | 4/2002 | Lauper et al. | 320/106 |
| 2005/0079820 | A1 | 4/2005 | Yamashita | 455/41.2 |
| 2007/0222681 | A1 | 9/2007 | Greene et al. | 343/700 |

FOREIGN PATENT DOCUMENTS

| | | | |
|---|---|---|---|
| EP | 0339628 | A2 | 4/1989 |
| EP | 1439487 | A2 | 7/2004 |

* cited by examiner

*Primary Examiner* — Douglas W Owens
*Assistant Examiner* — Dieu Hien T Duong
(74) *Attorney, Agent, or Firm* — Harrington & Smith

(57) ABSTRACT

A method including: optimizing space within a device by having a feed element for an antenna as an integral part of the device but not having the antenna as an integral part of the device; and providing the antenna as a part of a battery for the device. A radio communications device including: a battery comprising: a metal housing element; and an accessible conductive contact electrically connected to the metal housing; and a RF feed element for connection to the external conductive contact.

20 Claims, 2 Drawing Sheets

ANTENNA

CROSS-REFERENCE TO RELATED PATENT APPLICATION

This application is a Divisional of U.S. Ser. No. 11/412,623, filed on Apr. 26, 2006, now U.S. Pat. No. 7,538,730 issued on May 26, 2009.

FIELD OF THE INVENTION

Embodiments of the present invention relate to antennas. In particular, they relate to novel antennas that may save space in a device.

BACKGROUND TO THE INVENTION

In radio communication devices, the physical size of the device may be affected by the space occupied by an antenna element. It would be desirable to provide an antenna element in a device for radio communications without unnecessarily increasing the size or volume of the device.

Although this is generally important for all radio communications devices, it is particularly important for hand-portable radio communication devices, where space is a premium, and also for multi-mode radio communications devices that require multiple antenna elements.

BRIEF DESCRIPTION OF THE INVENTION

According to one embodiment of the invention there is provided a radio communications device comprising: a battery comprising a metal housing element and an accessible conductive contact electrically connected to the metal housing; and a radio frequency feed element for connection to the external conductive contact of the battery.

According to another embodiment of the invention there is provided a radio communications device comprising: a compartment for receiving a battery that has a metal housing element and an accessible conductive contact electrically connected to the metal housing element; and a radio frequency feed positioned within the compartment for connection to the accessible conductive contact when the battery is received within the compartment.

According to another embodiment of the invention there is provided a battery comprising: a metal housing element defining a cavity; one or more cells within the cavity; an insulating cover portion concealing the metal housing element; a first external contact and a second external contact for providing charge stored in the cell or cells to a device connected to the battery; and an aperture in the insulating cover portion exposing a portion of the metal housing for coupling, in use, to a radio frequency feed.

According to another embodiment of the invention there is provided a method comprising: optimizing space within a device by having a feed element for an antenna as an integral part of the device but not having the antenna as an integral part of the device; and providing the antenna as a part of a battery for the device.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
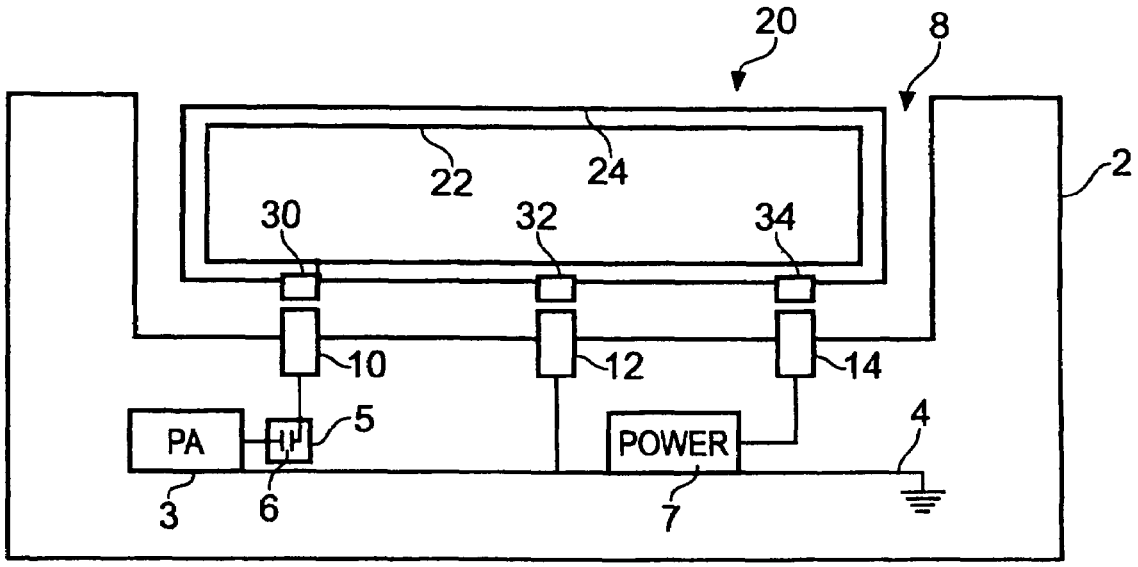
FIG. 1 schematically illustrates a radio communications device 2 and a battery 20 operable as an antenna.

FIG. 1 schematically illustrates a radio communications device 2 such as any electronic device that is operable to receive information via radio transmissions e.g. a television, a radio, pager, GPS receiver etc, any electronic device that is operable to transmit information via radio transmissions e.g. a beacon, RFID tag etc, and any electronic device that is operable to receive information via radio transmissions and also to transmit information via radio transmissions e.g. a RFID reader, a telephone, a set-top box etc.

The device 2 may be a fully functional apparatus or may be a module for incorporation within an apparatus. It may be hand-portable.

The radio communications device 2 comprises a compartment 8 for receiving a battery 20. The battery may be inserted into the compartment by a user of the device. It may also be replaceable by the user.

The battery 20 comprises a metal housing element 22, a cover portion 24, an accessible conductive contact 30 electrically connected to the metal housing element 22, and external contacts 32, 34

The external contacts 32, 34 provide charge stored in the battery to the device 2.

The metal housing element 22 transmits electromagnetic waves when the accessible conductive contact 30 is fed with radio frequency (RF) electrical signals. These radio frequency signals are passed from the accessible conductive contact 30 to the metal housing element 22 which operates as a radio frequency antenna element converting the radio frequency electrical signals into electromagnetic transmissions.

The metal housing element 22 can also receive electromagnetic waves, convert them to RF electrical signals and feed the RF electrical signals via the accessible conductive contact 30 to the device 2.

The metal housing element 22 can also receive electromagnetic waves, convert them to RF electrical signals and feed the RF electrical signals via the accessible conductive contact 30 to the device 2.

The bandwidth and/or resonant frequency of the antenna element 22 may be tuned by varying its size, the position of the accessible conductive contact 30 and its position relative to the PWB 4. For example, increasing the size of the metal housing element 22 will typically increase the electrical length of the antenna which in turn decreases the resonant frequency.

The metal housing element 22 may be arranged to operates as an antenna in, for example, one of the cellular telephone bands or the Bluetooth/WLAN frequency of 2.4 GHz. The cellular telephone bands include, but are not necessarily limited to: US-GSM 850 (824-894 MHz); EGSM 900 (880-960 MHz); PCN/DCS1800 (1710-1880 MHz); US-WCDMA1900 (1850-1990); WCDMA21000 (Tx: 1920-1980I Rx: 2110-2180); and PCS1900 (1850-1990 MHz).

The device 2 comprises power contact elements 12, 14 that automatically connect to the external contacts 32, 34 of the battery 20 when the battery is received in the compartment 8. The power contact elements 12, 14 are connected to power control circuitry 7 and a PWB 4 which operates as a ground.

The battery's external contacts 32, 34 provide charge stored in the battery 20 to the power control circuitry 7 of the device 2 via the power contact elements 12, 14.

The device 2 also comprises radio frequency circuitry 3. This circuitry may comprise receiver circuitry, transmitter circuitry or both transmitter and receiver circuitry depending upon applications. If transmitter circuitry is present it will typically comprise a power amplifier for generating the radio frequency electrical signals that are fed via the radio frequency feed element 10 to the metal housing element 22.

The radio frequency feed 10 is positioned within the compartment 8 so that it automatically connects with the external conductive contact 30 when the battery 20 is received within the compartment 8. The position of the radio frequency feed 10 therefore depends upon the position of the external conductive contact 30 on the battery 20.

The device 2 may also comprise a dc blocking device 5 such as a series connected capacitor 5 for preventing dc power passing from the battery 20 to the radio frequency circuitry 3 instead of to the power circuitry 7.

In the example illustrated, the accessible conductive contact 30 of the battery 20 is illustrated as functionally separate from one or other of the external contacts 32, 34. However, the accessible conductive contact 30 may be in electrical connection with (or even integrated with) one or other of the external contacts 32, 34 (FIGS. 3 and 4) or the accessible conductive contact 30 may be physically isolated from both the external contacts 32, 34 (FIG. 2).

Figure 2:
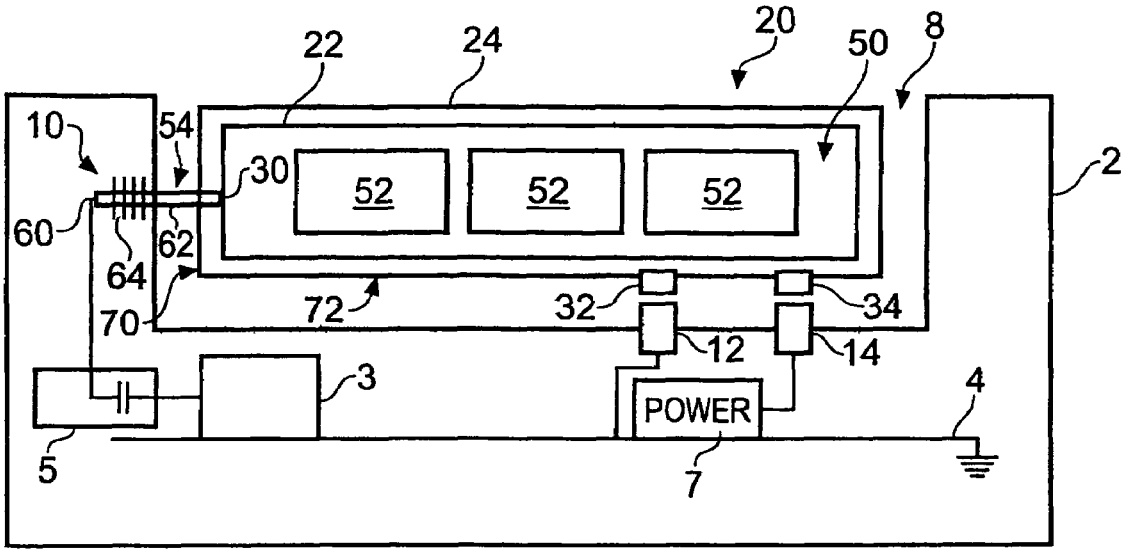
FIG. 2 schematically illustrates a first embodiment in which a modified battery 20 is operable as an antenna.

FIG. 2 illustrates a first embodiment that comprises features that are functionally similar to those illustrated in FIG. 1 and similar references are used to denote similar components.

In this particular example, the metal housing element 22 defines a cavity 50 that receives one or more cells 52 within the cavity 50. Such an arrangement may also be used in any one of the batteries 20 illustrated in the Figs.

However, in this embodiment, the insulating cover portion 24 that conceals the metal housing element 22 has an aperture 54 that exposes the metal housing element 22. This exposed portion of the metal housing element 22 functions as the accessible conductive contact 30.

The accessible conductive contact 30 is physically separated from the external contacts 32 and 34. It provides an RF feed and also provides for the charging and discharging of the battery 20.

The radio frequency feed 10 may, in this embodiment, be implemented as a spring biased pin contact 60. The pin 62 accesses the metal housing element 22 via the aperture 54 and is biased into abutting contact with the exposed portion 30 of the metal housing element 22 by the spring 64.

The biased pin contact 60 may be positioned far from the PWB 4 to prevent undesirable coupling effects. The exposed portion 30 may therefore be on one side 70 of the battery 20 while the external contacts 32, 34 are on a different side 72 of the battery.

Figure 3:
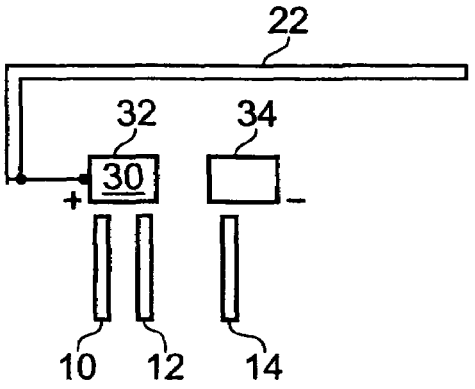
FIG. 3 schematically illustrate a second embodiment in which an unmodified battery 20 is operable as an antenna.

In FIG. 3, the accessible conductive contact 30 provides a radio frequency feed to the antenna element 22 and also provides for the charging and/or discharging of the battery 20. The battery 20 in this embodiment may be an existing battery that is advantageously re-used for an additional function or may be a new battery.

A first one 32 of the external contacts 32, 34 operates as a battery cathode and functions as the accessible conductive contact 30. The other of the external contacts 34 operates as a battery anode. The battery cathode 32 is directly connected to the metal housing element 22.

The radio frequency feed element 10 is positioned adjacent and parallel to the first power contact element 12 that connects with the battery cathode 32. The radio frequency feed element 10 is closer to the first power contact element 32 than the second power contact element 34.

Figure 4:
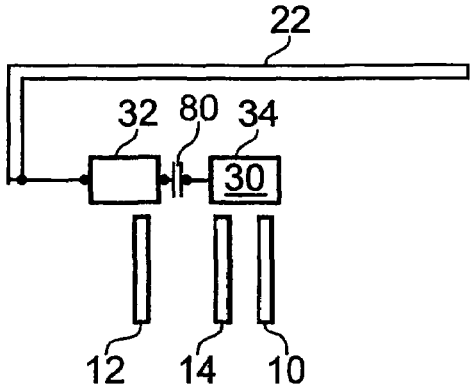
FIG. 4 schematically illustrate a third embodiment in which an unmodified battery 20 is operable as an antenna.

In FIG. 4, the accessible conductive contact 30 provides a radio frequency feed to the antenna element 22 and also provides for the charging and/or discharging of the battery 20. The battery 20 in this embodiment may be an existing battery that is advantageously re-used for an additional function or may be a new battery.

A second one 34 of the external contacts 32, 34 operates as a battery anode and functions as the accessible conductive contact 30. The other of the external contacts 32 operates as a battery cathode. The battery cathode 32 is directly connected to the metal housing element 22 and the battery anode 34 is connected to the battery cathode 32 via a capacitor 80.

The radio frequency feed element 10 is positioned adjacent and parallel to the second power contact element 14 that connects with the battery anode 34. The radio frequency feed element 10 is closer to the second power contact element 34 than the first power contact element 32.

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A battery comprising:

a metal housing element defining a cavity;

one or more cells within the cavity;

an insulating cover portion concealing the metal housing element;

a first external contact and a second external contact configured to provide charge stored in the cell or cells to a device connected to the battery; and an aperture in the insulating cover portion exposing a portion of the metal housing for coupling, in use, to a radio frequency feed, and wherein the exposed portion of the metal housing is physically separate from the first external contact and from the second external contact.

2. The battery as claimed in claim 1, which in use functions as an antenna.

3. The battery as claimed in claim 2, wherein the antenna element has a resonant frequency that includes 2.4 GHz.

4. The battery as claimed in claim 1 further comprising an accessible conductive contact electrically connected to the exposed portion of the metal housing element.

5. The battery as claimed in claim 4, wherein the radio frequency feed is a radio frequency feed element of the device.

6. The battery as claimed in claim 5, wherein the accessible conductive contact is for connection to the radio frequency feed element.

7. The battery as claimed in claim 6, wherein the battery is configured to be received by the device, and wherein the accessible conductive contact is configured to connect to the radio frequency feed element of the device when the battery is received by the device.

8. The battery as claimed in claim 1, wherein the first external contact is an external cathode contact.

9. The battery as claimed in claim 1, wherein the second external contact is an external anode contact.

10. An apparatus comprising:

a metal housing element defining a cavity;

one or more cells within the cavity;

an insulating cover portion concealing the metal housing element;

a first external contact and a second external contact configured to provide charge stored in the cell or cells to a device connected to the apparatus; and an aperture in the insulating cover portion exposing a portion of the metal housing for coupling, in use, to a radio frequency feed, and wherein the exposed portion of the metal housing is physcially separate from the first external contact and from the second external contact.

11. The apparatus as claimed in claim 10, wherein the apparatus is a battery.

12. The apparatus as claimed in claim 10, wherein the metal housing element is configured to operate as an antenna element.

13. The apparatus as claimed in claim 10 further comprising an accessible conductive contact electrically connected to the exposed portion of the metal housing element.

14. The apparatus as claimed in claim 13, wherein the radio frequency feed is a radio frequency feed element of the device.

15. The apparatus as claimed in claim 14, wherein the accessible conductive contact is for connection to the radio frequency feed element.

16. The apparatus as claimed in claim 15, wherein the apparatus is configured to be received by the device, and wherein the accessible conductive contact is configured to connect to the radio frequency feed element of the device when the apparatus is received by the device.

17. A method comprising:

providing a metal housing element defining a cavity;

providing one or more cells within the cavity;

providing an insulating cover portion concealing the metal housing element;

providing a first external contact and a second external contact configured to provide charge stored in the cell or cells to a device connected to the apparatus; and providing an aperture in the insulating cover portion exposing a portion of the metal housing for coupling, in use, to an radio frequency feed, and wherein the exposed portion of the metal housing is physically separate from the first external contact and from the second external contact.

18. The method as claimed in claim 17, wherein the apparatus is a battery.

19. The method as claimed in claim 17, wherein the metal housing element is configured to operate as an antenna element.

20. The method as claimed in claim 17 further comprising providing an accessible conductive contact electrically connected to the exposed portion of the metal housing element.

* * * * *